VIEW LIMITING DIAL AND RING STRUCTURE FOR COMBINATION LOCKS AND THE LIKE

BACKGROUND AND OBJECTS OF THE INVENTION

The present invention relates in general to combination locks, and more particularly to view limiting dial and dial ring assemblies for combination locks to afford security against unauthorized observation of the combination being dialed when opening the lock.

It has long been recognized that the dialing combination for combination locks are subject to theft by unauthorized viewing of the successive registrations of dial markings occurring during opening of the lock. Where such a lock is opened in the presence of other persons, it is a simple matter for each persons to note the combination from a point to the side of or at angles to the rear or over the shoulder of the operator and thereby gain unauthorized access to the vault, safe or other security receptacle protected by the lock. Even where some restriction of the field of view is achieved, persons do not have to see the entire combination dialed at one time, but can learn one number each time the unauthorized observer is able to look at the dial when the combination is being dialed by an authorized person, and thus over a short period of time acquire knowledge of the dialling combination without arousing suspicion of the authorized person opening the safe. Ideally, the dial should expose the indicia or numbers of the combination actually being run only to the authorized operator and not anyone standing elsewhere.

Heretofore, various expedients have been proposed for use in connection with conventional combination lock dials, which shield the greater portion of the dial from view by unauthorized persons. These have generally taken the form of a shield or cover provided with a window exposing only a limited number of the dial markings to view, either from a direction forwardly of the dial, or in some cases from a direction above the dial where the dial markings and numerals are merely provided on a peripheral cylindrical flange surface of the dial. Such dial shields have the dual purpose of tempering observation of the dial numbers by possible surreptitious observance to either side of the operator while the operator is dialing the combination, and limiting the range of exposed dial markings which are visible so that the body of the operator will shield the exposed dial area from observation by persons at remote locations or to the side of the operator. Earlier U.S. Pat. Nos. 2,728,215 to Bremer, 2,858,692 to Deaton et al, and 2,836,052 to Harry C. Miller, one of the joint inventors of this application, are typical of such prior structures. Such prior art dial shields, however, were usually in the form of additional accessories which must be associated with the combination lock and dial, and in many cases afford such a limited visible dial area that the lock dial must be operated very slowly in order to bring the proper numbers on the dial into registry with the index, zero or reference mark. Also because of the restricted visible dial area, the numbers are often so obscure or difficult to count that the operator must make a number of attempts before the successful combination is dialed. U.S. Pat. No. 2,690,664 to Harry C. Miller, and U.S. Pat. No. 4,197,726 to Uyeda are examples of combination lock dial and ring assemblies having a limited range of visibility forwardly of the dial, also for the purpose of reducing the chance of unauthorized viewing of the combination while it is being dialed by an authorized operator.

An object of the present invention is to provide a view limiting dial and dial ring assembly for combination locks and the like adapted to be mounted on vertical safe doors or similar vertical surfaces, which more severely limits the angular range of viewing positions in reflected light ray paths from which an authorized operator can dial the combination of the associated combination lock mechansim, further reducing the chance of unauthorized observation of the lock combination when being dialed.

Another object of the present invention is the provision of a novel view limiting dial and dial ring assembly for combination locks and the like as described in the preceding paragraph, wherein the numeral markings on the dial are provided on the rearwardly facing surface of the dial as mirror image numerals of normal dial marking numerals and are observable only by reflection from a reflective mirror surface rearwardly confronting the marked dial portion observable from a highly restricted range of observation points to the front and above the dial.

Another object of the present invention is the provision of a novel and ring assembly for combination locks and the like as described in the two immediately preceding paragraphs, wherein the index, zero or reference mark for the dial is provided as an opaque thin planiform vane member intercepting observation of portions of the forwardly visible dial markings from side locations.

Another object of the present invention is the provision of a novel dial and dial ring assembly for combination locks useable in view limiting installations as described in the preceding paragraphs and also interchangeable with members to provide restricted forward viewing of the dial without using reflective ray paths to observe dial markings.

Other objects, advantages and capabilities of the present invention will become apparent from the following detailed description, taken in conjunction with the accompanying drawings illustrating preferred embodments of the invention.

DETAILED DESCRIPTION OF THE FIGURES

maximum thickness from the forwardmost portion of the forwardly inclined surround 30 to the flat rear or back surface of the dial ring 28 is about ¾ of an inch.

Figure 1:
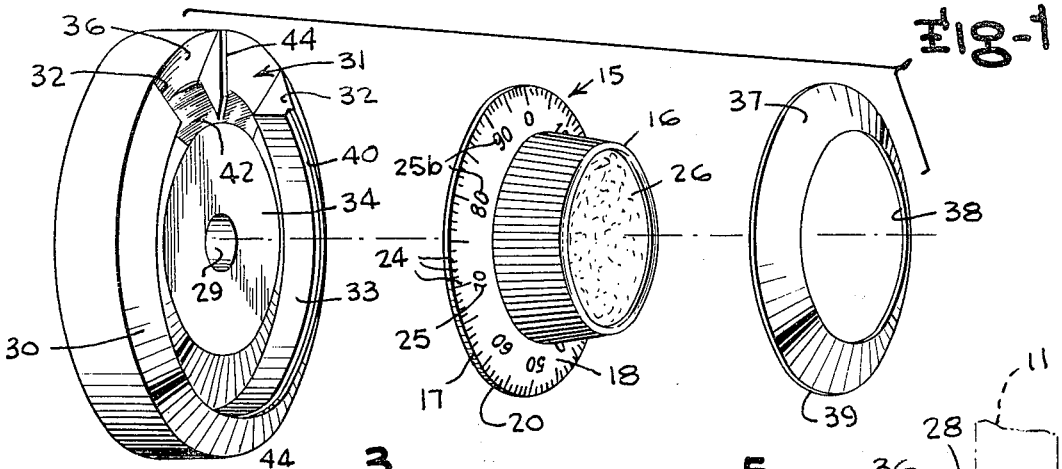
FIG. 1 is an exploded perspective view of a combination lock dial and ring assembly embodying the present invention.
Figure 2:
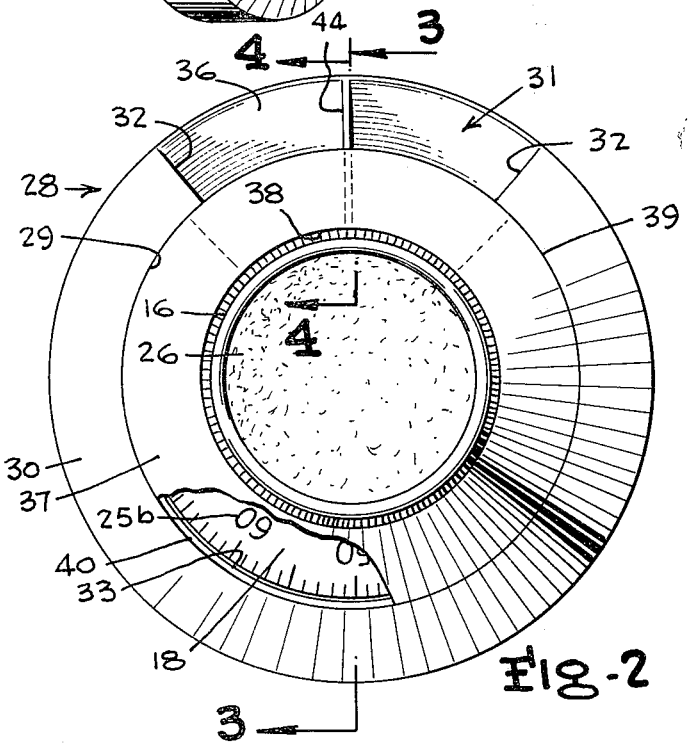
FIG. 2 is a front elevation view thereof.
Figure 3:
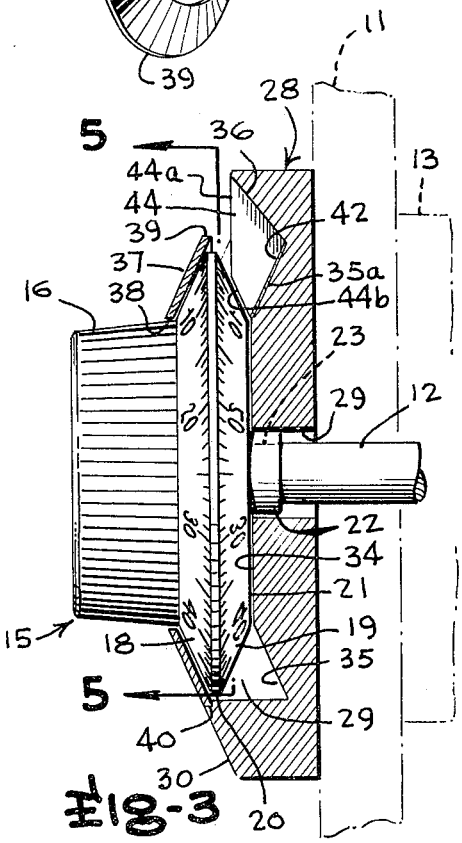
FIG. 3 is a vertical section view of the dial and ring assembly, taken along the line 3—3 of FIG. 2.
Figure 4:
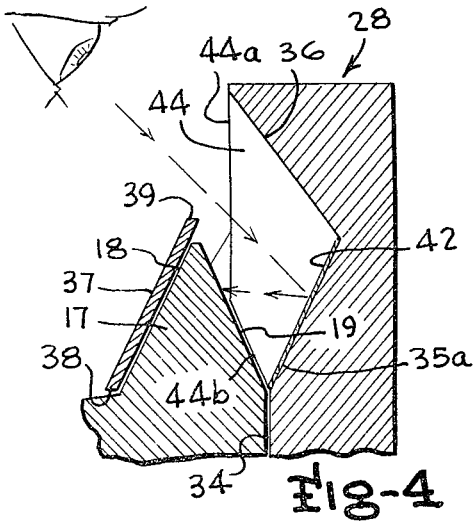
FIG. 4 is a detailed section view, to enlarged scale, taken along the line 4—4 of FIG. 2, showing reflecting light ray paths in broken lines.
Figure 5:
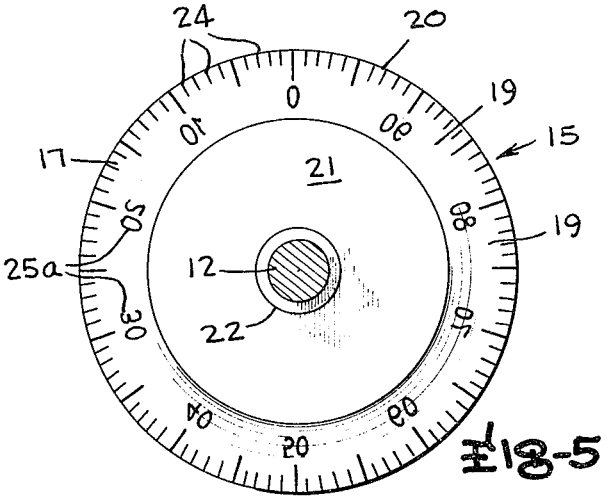
FIG. 5 is a rear elevation view of the combination lock dial and knob component, viewed from the line 5—5 of FIG. 3.

To prevent observation of the dial numerals **24*b* on the front dial face 18 of the tapered disc dial portion 17, an uninterrupted annular front cover 37 is provided which is of forwardly convergent truncated conical or frusto-conical configuration as will be apparent from FIG. 1, having a center opening 38 of an inner diameter corresponding closely to but just larger than the maximum diameter of the knob formation 16 of the dial and knob member 15. The outer rim 39 of the front cover 37 has a diameter corresponding to the diameter of the annular rabbet or groove 40 formed in the forwardmost edge portion of the outwardly bounding cylindrical side wall 33 of the forwardly facing well 29 to be tightly fitted therein by either a press-fit or secured by suitable adhesive means or the like. While the annular front cover 37 forms a sight barrier to front reading observation of the numeral indicia 25 on the dial portion 17, severely restricted observation of a reflected image of the mirror image or reversed numerals 25*a* on the rear dial face 19 is permitted by providing an annular arcuate truncated conical mirror strip 42 which is affixed to and spans the arcuate portion of the outwardly encircling truncated conical rear surface portion 35*a* of the well 29 spanning the circumferential extent of the sight opening 31 bounded by the bounding shoulders 32 and extends a short circumferential distance beyond the shoulders 32. With this arrangement the surface of the mirror strip 42 can be viewed by the operator from a severely restricted viewing zone and see by reflected light rays reflected by the surface of the mirror strip 42 a directly readable image of the mirror image indicia 25*a* on the rearwardly facing dial face 19 lying within the site opening or window region 31**.

To further restrict unauthorized observation of the dial numerals 25, the index mark or reference forming the fixed index for use in dialing the lock combination, in the preferred embodiment of the present invention, is formed by a thin opaque index vane 44 lying in a vertical plane through and including the center axis of the dial and knob member 15 and spindle 12 and dial ring 28. The rear edge of the vane 44 is of rearwardly convergent triangular configuration conforming to and secured intimately to the rearwardly convergent inclined surfaces 35 and 36 rearwardly bounding the sight opening 31. Its vertical forward edge portion **44*a* lies in the vertical plane perpendicular to the center axis of the dial ring 28 and located at the forwardmost edge of the outwardly and upwardly inclined surface 36, and has a rearwardly declining front edge portion 44*b* which declines from just above the uppermost level of the rim 20 of the tapered disc dial portion 17 to the juncture of the inclined truncated conical surface 35 with the flat annular rear wall portion 34 of the well 29**.

With this arrangement, it will be seen that the opaque character of the index mark vane 44 forms a barrier at a wide range of lateral angles to observation of the reflected image of the numerical indicia **25*a* on the rear dial face 19 of the dial formation 17 lying in the portions of the gap or sight window 31 to the opposite side of the index vane 44 from the observer, and the necessity of viewing the numbers by observing the mirror images reflected from the mirror strip 42 of the mirror image in numerical indicia 25*a* on the rearwardly facing dial face 19** greatly restricts the range of positions from which the numbers on the dial can be observed.

Figure 6:
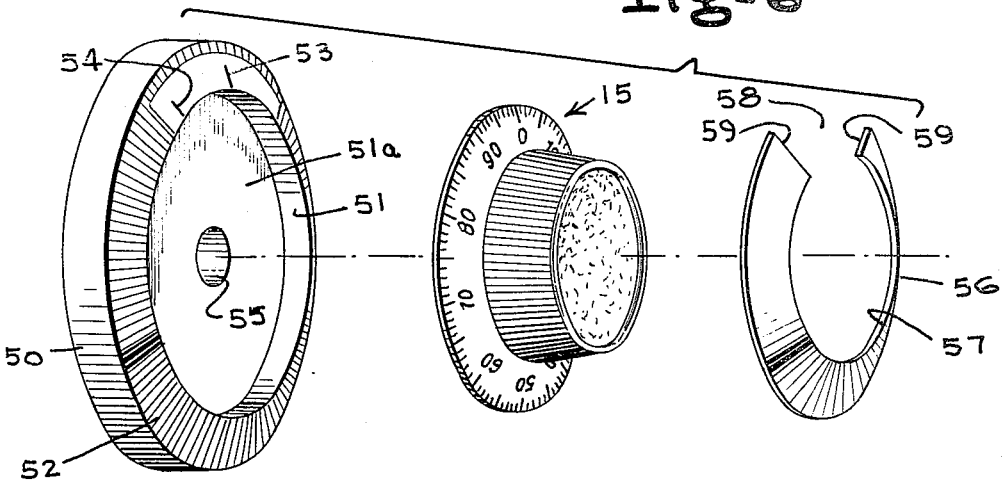
FIG. 6 is an exploded perspective view of a further embodiment employing the dial and knob of the previously described embodiment but with a different dial ring and shield structure for forward viewing applications.
Figure 7:
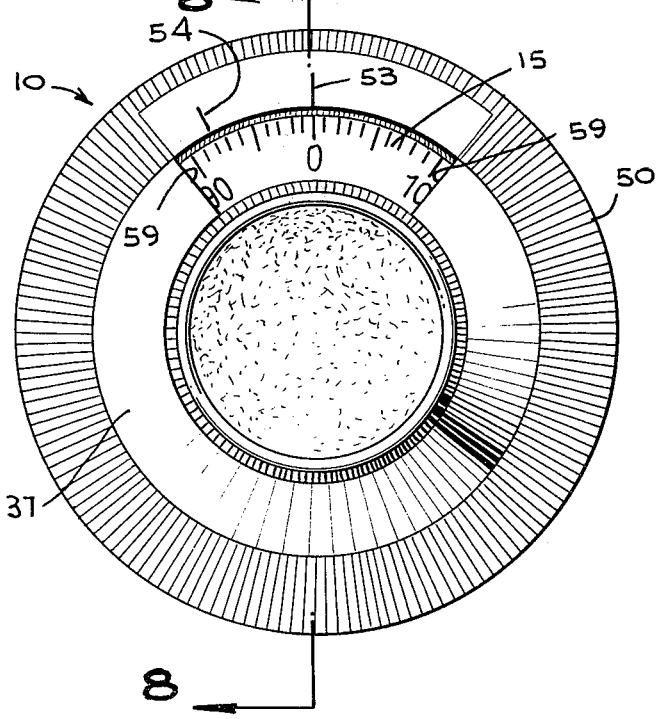
FIG. 7 is a front elevation view of the embodiment of FIG. 6.
Figure 8:
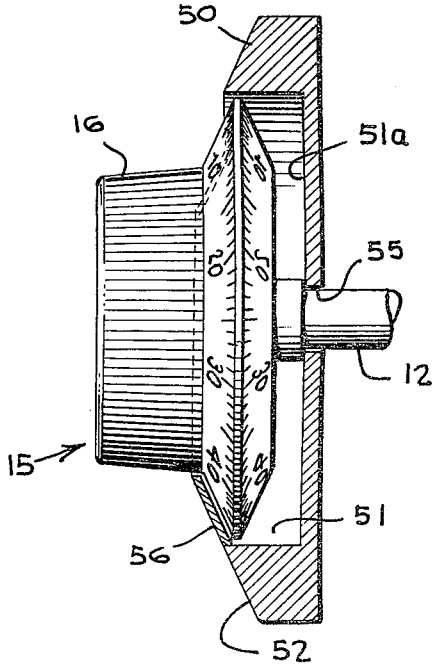
FIG. 8 is a vertical section view, taken along the line 8—8 of FIG. 7.

To increase the flexibility of the dial and dial ring assembly, a different embodiment of dial ring and front cover is made available, as illustrated in FIGS. 6 to 8, wherein the same dial and knob member 15 constructed in exactly the same manner as that described in connection with the preceding embodiment, is provided, but wherein the dial ring, indicated by the reference character 50, instead of being provided with the sight opening, mirror strip and relatively deeper recessed well described in the preceding embodiment, is simply provided with a shallow forwardly facing cylindrical well 51 bounded by an uninterrupted forwardly convergent annular truncated conical surround surface 52 having a reference index marking 53 thereon vertically aligned with the center axis of the dial ring and dial and knob member, and having a change index mark 54 circumferentially spaced therefrom. The center opening 55 in the modified dial ring 50 is of smaller diameter than the center opening 29 of the previously described dial ring 28, and is merely of a diameter corresponding substantially to the diameter of the dial spindle 12 to accommodate the spindle, so that the cylindrical boss 22 of the dial and knob member 15 which surrounds the spindle abuts against the forwardly facing rear wall **51*a* of the modified dial ring 50. In this embodiment, designed for front reading of the dial numerals, and annular front cover ring, indicated by the reference character 56 is a forwardly convergent, annular truncated conical or frusto-conical thin shield, similar to the uninterrupted front cover shield or ring 38, having a center opening 57 similar to the center opening 38 and corresponding substantially to the maximum diameter of the knob formation 16 on the dial and knob member 15, to receive the knob formation is forwardly projecting relation therethrough, but being interrupted to provide a sight opening 58 of about 80° symmetrically centered with the index reference mark 53, bounded by the radial ends 59 of the annular cover ring 56 laterally bounding the sight opening 58. With this arrangement, the same dial and knob member 15 can be readily adapted for use either as a top reading combination lock for severely restricted viewing along reflected light ray paths only, or can be readily used where desired in less expensive forward reading combination lock installations by simply replacng the dial ring 28 and front cover 37 with the dial ring 50 and front cover 56** of the later described embodiment.

It will also be appreciated that in each of the two above described preferred embodiments, the dial graduation markings or lines 24 on the front dial face 18 of the dial formation 17 may be eliminated along with the directly readable dial numerals **25*b* if only indirect reflected light top reading combination lock dialing is desired, and the rearwardly facing reverse or mirror image numerals 25*a* and associated dial graduation markings 24 on the rear dial face 19** may be eliminated if only forward reading combination lock dialing is desired.

While but two embodiments of the invention have been particularly shown and described, it is apparent that various modifications may be made in the invention without departing from the spirit and scope thereof, and that all changes and modifications coming within the scope of the appended claims are intended to be embraced thereby.

We claim:

1. A combination lock dial and ring assembly for combination locks and the like for limited range top reading of the dial indicia by reflected light rays only, comprising a rotatable dial member having a circular dial portion and a knob formation projecting forwardly therefrom, the dial portion including a rearwardly facing annular indicia bearing surface adjacent said periphery having rearwardly facing dial graduations and mirror image reversed dial numerals thereon, said annular indicia bearing surface defining a frustro-conical annulus outwardly bounded by the circular periphery of the dial portion and lying in a rearwardly convergent cone of revolution concentric with the center axis of the dial inclined at substantially the same angle to said center axis as the cone of revolution of said mirror surface and in the opposite direction, and a dial ring having a forwardly facing dial receiving cylindrical well encircled by an integral shielding surround ring formation over a sufficient extent to exclude observation of the dial graduations and numerals laterally and below the dial portion and having an interruption of limited circumferential extend providing a sight opening for observation of the dial graduations and numerals in a restricted observation zone generally above and vertically aligned with the axis of the dial member, the rear surface of the dial receiving well having an arcuate light-reflecting mirror surface carried on and conforming to the shape of said rear surface at least spanning the arcuate extent of said sight opening positioned to reflect light rays from said dial graduations and numerals along reflection ray paths extending along upwardly and forwardly inclined paths to said restricted observation zone for visual observation of the rearwardly facing numerals and dial graduations confronting the mirror surface.

2. A combination lock dial and ring assembly as defined in claim 1, wherein said light-reflecting mirror surface is a reflective arcuate strip concentric with the center axis of the dial and lying in a forwardly convergent cone of revolution about said axis.

3. A combination lock dial and ring assembly as defined in claim 1, wherein said light-reflecting mirror surface is a reflective arcuate strip concentric with the center axis of the dial and lying in a forwardly convergent cone of revolution about said axis to incline upwardly and rearwardly from adjacent the edge of said annular indicia bearing surface nearest said center axis.

4. A combination lock dial and ring assembly as defined in claim 2, wherein said annular indicia bearing surface defines a frusto-conical annulus outwardly bounded by the circular periphery of the dial portion and lying in a rearwardly convergent cone of revolution concentric with the center axis of the dial.

5. A combination lock dial and ring assembly as defined in claim 2, wherein said annular indicia bearing surface defines a frusto-conical annulus outwardly bounded by the circular periphery of the dial portion and lying in a rearwardly convergent cone of revolution concentric with the center axis of the dial inclined at substantially the same angle to said center axis as the cone of revolution of said mirror surface.

6. A combination lock dial and ring assembly as defined in claim 2, wherein said annular indicia bearing surface defines a frusto-conical annulus outwardly bounded by the circular periphery of the dial portion and lying in a rearwardly convergent cone of revolution concentric with the center axis of the dial inclined at substantially the same angle to said center axis as the cone of revolution of said mirror surface and in the opposite direction.

7. A combination lock dial and ring assembly as defined in claim 3, wherein said annular indicia bearing surface defines a frusto-conical annulus outwardly bounded by the circular periphery of the dial portion and lying in a rearwardly convergent cone of revolution concentric with the center axis of the dial inclined at substantially the same angle to said center axis as the cone of revolution of said mirror surface and in the opposite direction.

8. A combination lock dial and ring assembly as defined in claim 2, wherein said annular indicia bearing surface defines a frusto-conical annulus outwardly bounded by the circular periphery of the dial portion and lying in a rearwardly convergent cone of revolution concentric with the center axis of the dial, said annulus being inwardly bounded by a circular inner edge spaced radially from said center axis the same distance as the innermost edge of said reflective arcuate strip and located immediately adjacent said innermost edge in forward alignment therewith and with the periphery of said knob formation.

9. A combination lock dial and ring assembly as defined in claim 3, wherein said annular indicia bearing surface defines a frusto-conical annulus outwardly bounded by the circular periphery of the dial portion and lying in a rearwardly convergent cone of revolution concentric with the center axis of the dial, said annulus being inwardly bounded by a circular inner edge spaced radially from said center axis the same distance as the innermost edge of said reflective arcuate strip and located immediately adjacent said innermost edge in forward alignment therewith and with the periphery of said knob formation.

10. A combination lock and dial ring assembly for combination locks and the like for limited range top reading of the dial indicia by reflected light rays only, comprising a rotatable dial member having a circular dial portion and a knob formation projecting forwardly therefrom, the dial portion including a rearwardly facing annular indicia bearing surface adjacent said periphery having rearwardly facing dial graduations and mirror image reversed dial numerals thereon, and a dial ring having a forwardly facing dial receiving cylindrical well encircled by an integral shielding surround ring formation over a sufficient extent to exclude observation of the dial graduations and numerals laterally and below the dial portion and having an interruption of limited circumferential extent providing a sight opening for observation of the dial graduations and numerals in a restricted observation zone generally above and vertically aligned with the axis of the dial member, the rear surface of the dial receiving well having an arcuate light-reflecting mirror surface at least spanning the arcuate extent of said sight opening positioned to reflect light rays from said dial graduations and numerals along reflection ray paths extending along upwardly and forwardly inclined paths to said restricted observation zone for visual observation of the rearwardly facing numerals and dial graduations confronting the mirror surface, the outer peripheral region of the dial portion being of isosceles triangular cross-section converging outwardly from the periphery of said knob formation and providing frustro-conical rear and front inclined dial faces, the rear dial face forming said annular indicia bearing surface.

11. A combination lock dial and ring assembly as defined in claim 10, wherein said light-reflecting mirror surface is a reflective arcuate strip concentric with the center axis of the dial and lying in a forwardly convergent cone of revolution about said axis.

12. A combination lock dial and ring assembly as defined in claim 1, wherein sid light-reflecting mirror surface is a reflective arcuate strip concentric with the center axis of the dial and lying in a forwardly convergent cone of revolution about said axis to incline upwardly and rearwardly from adjacent the edge of said annular indicia bearing surface nearest said center axis.

13. A combination lock dial and ring assembly as defined in claim 10, wherein the rear dial face forming said annular indicia bearing surface and said front dial face having like forwardly facing dial graduations and directly readable numerals thereon.

14. A combination lock dial and ring assembly as defined in claim 11, wherein the rear dial face forming said annular indicia bearing surface and said front dial face having like forwardly facing dial graduations and directly readable numerals thereon.

15. A combination lock dial and ring assembly as defined in claim 12, wherein the rear dial face forming said annular indicia bearing surface and said front dial face having like forwardly facing dial graduations and directly readable numerals thereon.

16. A combination lock dial for combination locks and the like for alternative use in laterally shielded top reading and front reading installations, comprising a rotatable dial member having a circular dial portion and a knob formation projecting forwardly therefrom having a knob periphery of predetermined smaller diameter than the diameter of the dial portion, the dial portion having an annular outer peripheral region extending radially outwardly from an inner boundry circle adjacent the periphery of the knob formation to the peripheral circular edge of the dial portion, said outer peripheral region having an isosceles triangular cross-section converging outwardly toward said circular edge from said boundry circle and providing frusto-conical rear and front inclined annular dial faces lying in rearwardly and forwardly converging cones of revolution about the center axis of the dial respectively, said rear and front dial faces having aligned dial graduations thereon and having aligned rearwardly facing mirror image numerals and forwardly facing directly readable corresponding numerals respectively.

17. A combination lock dial as defined in claim 16, wherein said dial member has a flat annular rear planiform surface lying in a plane perpendicular to said center axis and extending from said boundry circle to a location near said center axis to contact and revolve against a flat surface of a dial ring.

* * * * *

United States Patent [19]

Hennessy

[11] 4,404,824

[45] Sep. 20, 1983

[54] SIDE-BAR LOCK

[75] Inventor: Thomas F. Hennessy, Bristol, Conn.

[73] Assignee: Lori Corporation, Southington, Conn.

[21] Appl. No.: 231,777

[22] Filed: Feb. 5, 1981

[51] Int. Cl.[3] ..... E05B 27/06

[52] U.S. Cl. ..... 70/364 A; 70/419; 70/358

[58] Field of Search ..... 70/358, 364 R, 364 A, 70/365, 366, 416, 419, 421

[56] References Cited

U.S. PATENT DOCUMENTS

| | | | |
|---|---|---|---|
| 2,648,973 | 8/1953 | Spain | 70/366 |
| 2,690,070 | 9/1954 | Spain | 70/421 |
| 3,479,849 | 11/1969 | Check | 70/364 A |
| 3,837,197 | 9/1974 | Lopez | 70/364 A |
| 3,857,263 | 12/1974 | Garther | 70/364 A |

FOREIGN PATENT DOCUMENTS

| | | | |
|---|---|---|---|
| 2055948 | 3/1981 | United Kingdom | 70/358 |

*Primary Examiner*—Robert L. Wolfe

[57] ABSTRACT

A compact cylinder lock operated by a key having smooth edges and detents in opposed side faces. The locking mechanism includes series connected pin tumblers and side bars which are resiliently biased. A resiliently biased fence cooperates with the side bars and lock housing; the fence moving out of engagement with the housing and into gates in the side bars when the side bars are moved a sufficient distance by the pin tumblers.

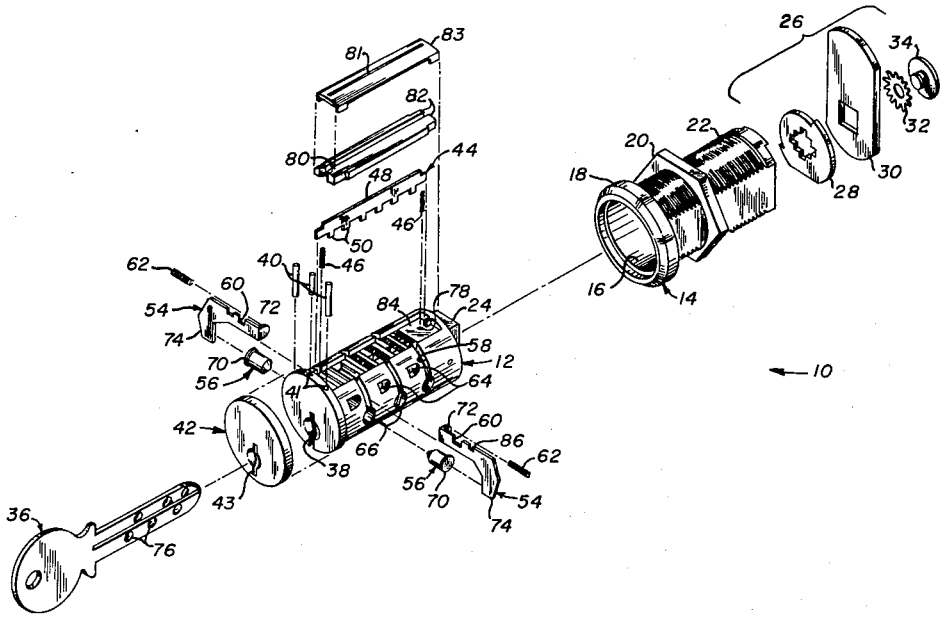

19 Claims, 5 Drawing Figures